US008251748B2

(12) United States Patent
Tyler et al.

(10) Patent No.: US 8,251,748 B2
(45) Date of Patent: Aug. 28, 2012

(54) CONNECTOR ASSEMBLY HAVING A CAVITY SEALING PLUG

(75) Inventors: Adam Price Tyler, Rochester Hills, MI (US); Thomas R. DeWitte, Shelby Township, MI (US)

(73) Assignee: Tyco Electronics Corporation, Berwyn, PA (US)

( * ) Notice: Subject to any disclaimer, the term of this patent is extended or adjusted under 35 U.S.C. 154(b) by 59 days.

(21) Appl. No.: 12/684,347

(22) Filed: Jan. 8, 2010

(65) Prior Publication Data

US 2011/0171856 A1 Jul. 14, 2011

(51) Int. Cl.
*H01R 9/03* (2006.01)

(52) U.S. Cl. ..... 439/607.52

(58) Field of Classification Search ..... 439/607.52, 439/610, 60, 271, 347, 460
See application file for complete search history.

(56) References Cited

U.S. PATENT DOCUMENTS

| | | | | |
|---|---|---|---|---|
| 4,993,964 | A | 2/1991 | Trummer | |
| 5,810,620 | A * | 9/1998 | Kobayashi et al. | 439/607.41 |
| 6,171,144 | B1 | 1/2001 | Stone | |
| 6,786,757 | B2 * | 9/2004 | Pocrass | 439/418 |
| 7,481,675 | B2 | 1/2009 | Patterson et al. | |
| 7,540,772 | B2 * | 6/2009 | Sardi et al. | 439/581 |
| 7,556,536 | B2 * | 7/2009 | Caveney et al. | 439/676 |
| 7,559,797 | B2 | 7/2009 | Shishikura et al. | |
| 2004/0033721 | A1 * | 2/2004 | Pocrass | 439/578 |
| 2008/0102686 | A1 * | 5/2008 | Carreras Garcia et al. | 439/392 |

* cited by examiner

*Primary Examiner* — Jean F Duverne

(57) ABSTRACT

A connector assembly includes an outer housing, an electromagnetic shield, and a plug. The outer housing includes an interior chamber and an opening. The electromagnetic shield is disposed within the outer housing and includes a conductive body having an interior compartment with an aperture. The plug is disposed in the opening of the outer housing and is engaged with the shield around the aperture of the shield. The plug seals the opening in the outer housing and the aperture in the shield to prevent ingress of contaminants into the interior chamber of the outer housing. The plug also restricts emission of electromagnetic interference from the interior compartment of the shield.

22 Claims, 7 Drawing Sheets

CONNECTOR ASSEMBLY HAVING A CAVITY SEALING PLUG

BACKGROUND OF THE INVENTION

This invention relates generally to electrical connectors, and more particularly, to connectors that include electromagnetic shields.

Some known connectors are high voltage connectors that are used in the automotive industry. These connectors may transfer electric current between or among several sources of current and/or between sources of the current and electric loads within a vehicle. For example, some connectors may include conductors and contacts that mate with contacts in another connector to convey current therebetween. The connectors may include electromagnetic shields that are formed of conductive materials. The shields partially enclose the conductors and/or contacts to reduce the amount of electromagnetic interference that escapes the connector.

Some connectors include a housing that houses an electrical terminal, where some of the terminal receiving cavities of one of the electrical connectors, particularly the socket housing, require an empty cavity, that is, where an electrical terminal is not loaded therein. In such cases, and when a rear seal is installed, a sealing plug can be inserted through the seal to seal the empty cavity.

The empty cavity may provide access to the interior of the connector. If the sealing plug does not adequately seal the cavity, contaminants such as moisture and dirt may enter into the interiors of the connectors. Moreover, some known sealing plugs do not restrict emission of electromagnetic interference (EMI) from the interior of the shield.

A need exists for a connector assembly that prevents ingress of contaminants into cavities of the connector assembly while restricting emission of EMI from the connector assembly.

BRIEF DESCRIPTION OF THE INVENTION

In one embodiment, a connector assembly is provided. The connector assembly includes an outer housing, an electromagnetic shield, and a plug. The outer housing includes an interior chamber and an opening. The electromagnetic shield is disposed within the outer housing and includes a conductive body having an interior compartment with an aperture. The plug is disposed in the opening of the outer housing and is engaged with the shield around the aperture of the shield. The plug seals the opening in the outer housing and the aperture in the shield to prevent ingress of contaminants into the interior chamber of the outer housing. The plug also restricts emission of electromagnetic interference from the interior compartment of the shield.

In another embodiment, another connector assembly is provided. The connector assembly includes an outer housing, an electromagnetic shield, a retainer, a cable seal, and a plug. The outer housing includes an interior chamber and an opening. The electromagnetic shield is disposed within the outer housing and includes a conductive body having an interior compartment and an aperture. The retainer is joined to the outer housing. The cable seal is disposed between the retainer and the outer housing and includes a channel extending therethrough. The plug extends through the opening in the outer housing, the aperture in the shield, and the channel in the cable seal. The plug prevents ingress of contaminants into the interior chamber of the outer housing by sealing the opening in the outer housing and restricts emission of electromagnetic interference by electrically sealing the aperture in the shield.

DETAILED DESCRIPTION OF THE INVENTION

Figure 1:
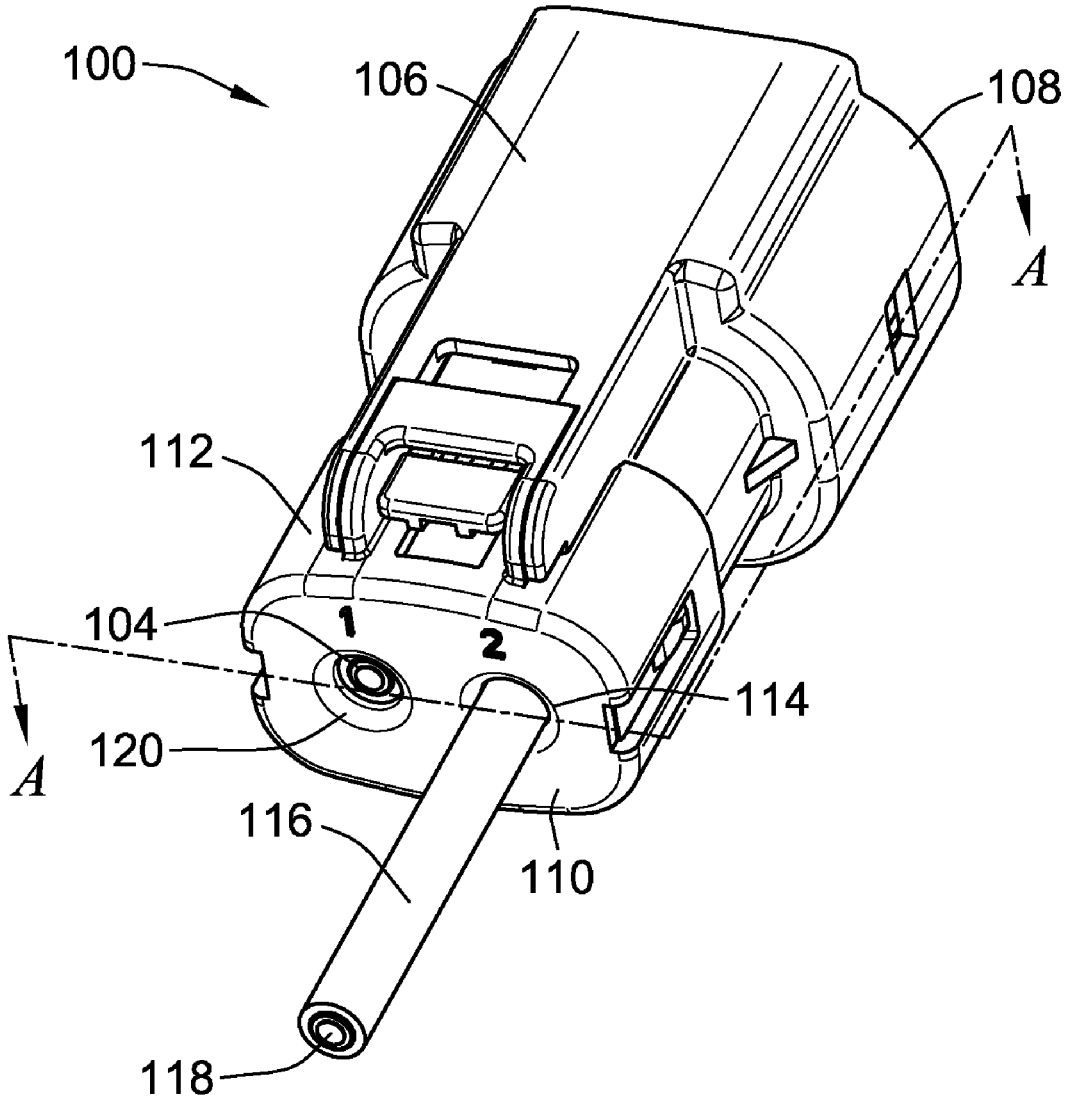
FIG. 1 is a perspective view of a connector assembly in accordance with one embodiment of the present disclosure.

FIG. 1 is a perspective view of a connector assembly 100 in accordance with one embodiment of the present disclosure. The connector assembly 100 may mate with another connector (not shown) to transfer electric current in a high voltage power system in one embodiment. By way of example only, the connector assembly 100 may mate with a header assembly to convey electric current between two components, such as batteries, in a high voltage power system of a vehicle. While the embodiments set forth below are described in terms of a high voltage power system for a vehicle, alternatively one or more embodiments may be applicable to systems other than a high voltage system or for power systems used with devices other than a vehicle. For example, one or more embodiments may be used in conjunction with a low voltage system or for a power system for a device other than a vehicle.

The connector assembly 100 includes one or more plugs 104. The plug is disposed in an unused cavity. As described herein, the plug 104 provides both an environmental seal and closure of the electromagnetic interface (EMI) shielding or an EMI seal for the connector assembly 100. The environmental seal provided by the plug 104 prevents ingress of contaminants such as water, other fluids, dirt, and the like into the interior of the connector assembly 100. The EMI seal provided by the plug 104 restricts emission of EMI from the connector assembly 100.

The connector assembly 100 includes an outer housing 106 and a retainer 112 that are coupled with one another. The outer housing 106 and retainer 112 longitudinally extend from a mating end 108 of the outer housing 106 to an opposite back end 110 of the retainer 112. The mating end 108 defines an interface to mate the connector assembly 100 with another connector assembly.

As described below, the connector assembly comprises one or more cavities 222, 224 (shown in FIG. 2). At least one conductor 118 and contact 220 (shown in FIG. 2) are disposed in the one of the cavities 222, 224 in an inner housing 214 of the connector assembly 100. The contact 220 and conductor 118 are electrically coupled. The contact 220 mates with a corresponding contact (not shown) in the mating connector assembly. The conductor 118 extends from the contact 220 through the outer housing 106 and retainer 112 and out of the back end 110 of the retainer 112. As shown in FIG. 1, the retainer 112 includes an opening 114 through which a cable 116 extends. The conductor 118 is disposed within the cable 116. The conductor 118 and cable 116 may extend to another component (not shown), such as a battery.

The back end 110 of the retainer 112 includes at least one additional opening 120 for additional conductors. When the opening is unused, the plug 104 is disposed in the opening 120 to prevent ingress of contaminants into the outer housing 106 through the opening 120. The opening 120 may be present in the retainer 112 due to the mass manufacturing of retainers 112. For example, many retainers 112 may be manufactured for different connector assemblies. Some of the connector assemblies may include cables 116 extending through all of the openings 114, 120 in the retainer 112. Other connector assemblies such as the connector assembly 100 may not have a cable 116 extending through all of the openings 114, 120. The plug 104 is disposed in one or more of the openings 120 that do not have a cable 116 extending therethrough in order to prevent ingress of contaminants through the openings 120.

Figure 2:
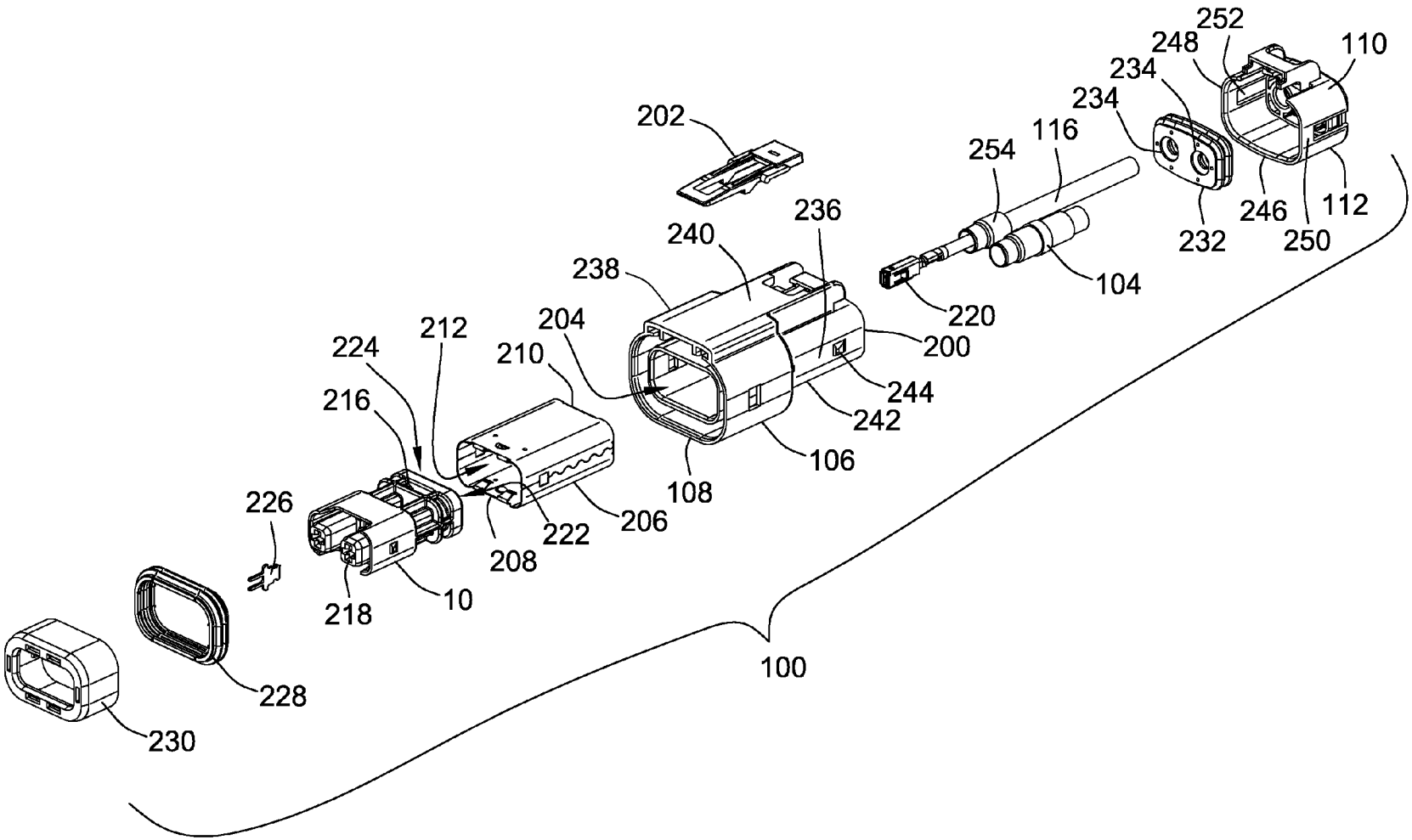
FIG. 2 is an exploded view of the connector assembly shown in FIG. 1 in accordance with one embodiment of the present disclosure.

FIG. 2 is an exploded view of the connector assembly 100 in accordance with one embodiment of the present disclosure. The outer housing 106 extends from the mating end 108 to a back end 200. The outer housing 106 may include, or be formed from, a dielectric material. For example, the outer housing 106 may be molded from one or more polymers. Alternatively, the outer housing 106 may include, or be formed from, a conductive material. The outer housing 106 includes an interior chamber 204 disposed between the mating end 108 and back end 200. In the illustrated embodiment, the interior chamber 204 extends from the mating end 108 to an interior wall 504 (shown in FIG. 5) that is located inside the outer housing 106. The outer housing 106 includes opposite side surfaces 236, 238 and opposite upper and lower surfaces 240, 242. The side surfaces 236, 238 include protrusions 244 that project in opposite directions from the respective side surfaces 236, 238. A latch 202 may be joined to the upper surface 240. The latch 202 couples the connector assembly 100 to a mating connector (not shown).

An electromagnetic shield 206 is disposed within the interior chamber 204 of the outer housing 106. The shield 206 is a shell that includes or is formed from a conductive material, such as a metal or metal alloy. The shield 206 longitudinally extends between opposite ends 208, 210 and defines an interior compartment 212 between the ends 208, 210. The shield 206 surrounds or at least partially encloses the contact 220 within the shield 220.

Figure 10:
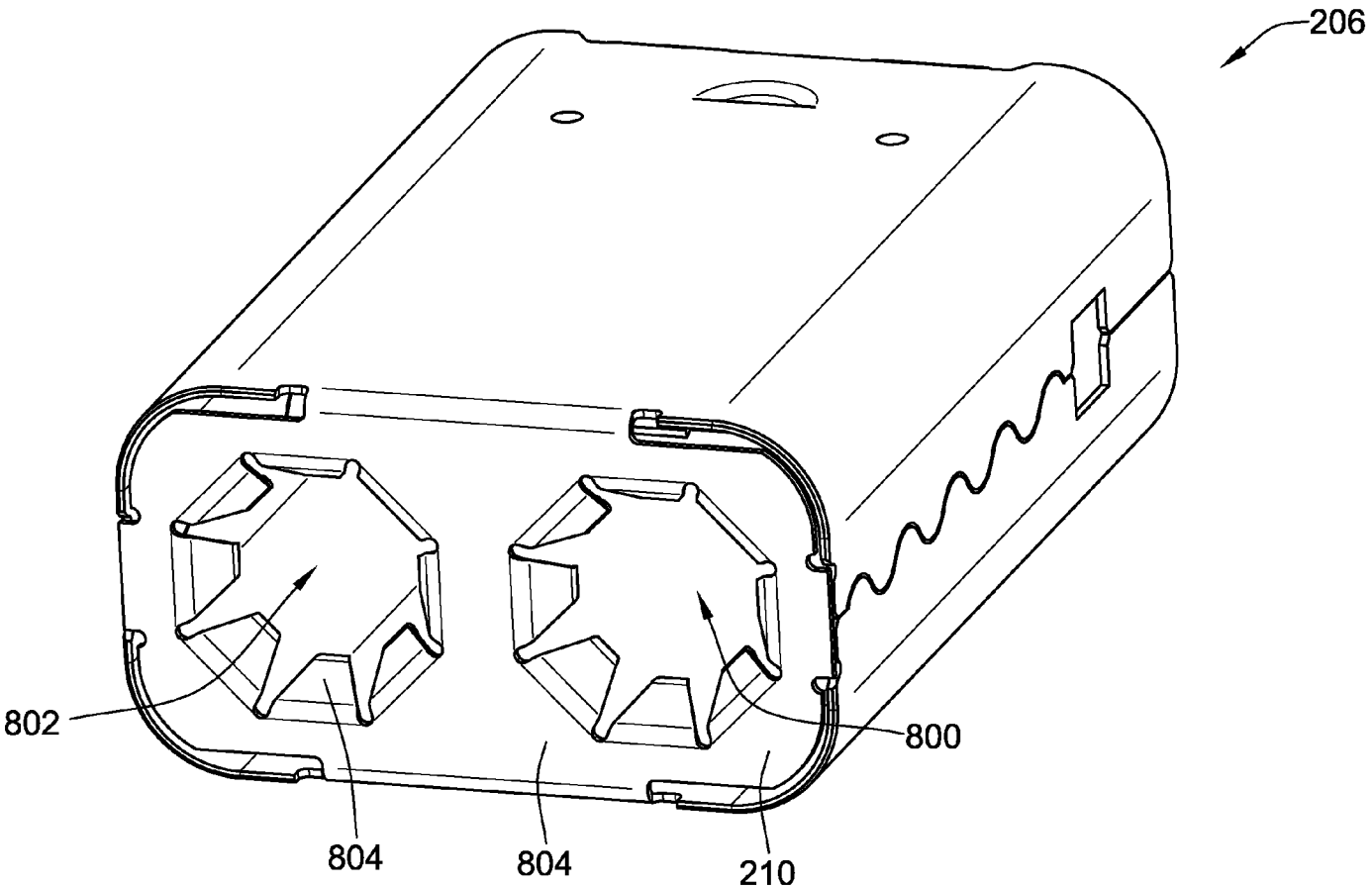
FIG. 10 is a rear perspective view of an electromagnetic shield shown in FIG. 2 in accordance with one embodiment of the present disclosure.

FIG. 10 is a rear perspective view of the shield 206 in accordance with one embodiment of the present disclosure. As shown in FIG. 10, the back end 210 of the shield 206 includes two apertures 800, 802. The apertures 800, 802 provide access to the interior compartment 212 (shown in FIG. 2) of the shield 206. In the illustrated embodiment, the shield 206 includes several extensions 804 around the periphery of each aperture 800, 802. The extensions 804 may be spring fingers or other protrusions that inwardly extend toward the axial center of the corresponding aperture 800, 802. Alternatively, the shield 206 may include different extensions 804 or not include the extensions 804. As described below, the extensions 804 of the aperture 800 are engaged by a collar 254 (shown in FIG. 2) of the cable 116 (shown in FIG. 1) when the contact 220 (shown in FIG. 2) is loaded into the shield 206. The extensions 204 of the aperture 802 are engaged by a conductive cap 302 (shown in FIG. 3) of the plug 104 (shown in FIG. 1). The engagement between the collar 254 and the extensions 804 of the aperture 800 and the engagement between the conductive cap 302 and the extensions 804 of the aperture 802 may electrically seal the apertures 800, 802 so as to restrict emission of EMI from the shield 206.

Returning to the discussion of the connector 100 as shown in FIG. 2, an inner housing 214 is located within the interior compartment 212 of the shield 206. The inner housing 214 extends from a back end 216 to a front end 218. The inner housing 214 includes, or is formed from, a dielectric material. For example, the inner housing 214 may be molded from one or more polymers. Alternatively, the inner housing 214 may include, or be formed from, one or more conductive materials. The front end 218 mates with the mating connector (not shown) to couple the contact 220 of the connector assembly 100 with a corresponding contact (not shown) in the mating connector.

The inner housing 214 includes two elongated cavities 222, 224 that extend through the inner housing 214. In the illustrated embodiment, the cavities 222, 224 are oriented parallel to one another and extend through the inner housing 214 from the back end 216 to the front end 218. The contact 220 and at least a portion of the cable 116 are disposed in the cavity 224. The contact 220 and cable 116 are positioned in the cavity 224 such that the contact 220 is disposed at or near the front end 218 of the inner housing 214 and so that the contact 220 may mate with a corresponding contact (not shown) in the mating connector assembly. The cable 116 includes a collar 254 that circumferentially surrounds the cable 116. The cable 116 may be loaded into the cavity 224 until the collar 254 engages the shield 206 within the outer housing 106. The collar 254 may include, or be formed from, a conductive material such as a metal or metal alloy. The engagement of the collar 254 with the shield 206 may provides an electromagnetic "seal" or closure in the shield 206 to prevent or restrict emission of EMI from within the shield 206.

In the exemplary embodiment, the cavity 222 is an unused channel. The plug 104 is disposed in the cavity 222. As described below, the plug 104 partially extends into the cavity 222 to seal both the shield 206 and the cavity 222 in order to provide EMI and environmental sealing of the shield 206 and the cavity 222, respectively. Alternatively, the contact 220 and a portion of the cable 116 may be located in the cavity 222 while the plug 104 is partially disposed in the cavity 224.

An electric shunt 226 is joined to the inner housing 214 at or proximate to the front end 218. The electric shunt 226 may be press-fit into the inner housing 214. Alternatively, the electric shunt 226 may be held in the inner housing 214 using an adhesive or solder. In one embodiment, the electric shunt 226 includes, or is formed from, a conductive material. For example, the electric shunt 226 may be stamped from a metal sheet. The electric shunt 226 may be a conductive body that mates with one or more contacts or conductive terminals (not shown) in the mating connector assembly (not shown) to close an electric circuit. For example, the mating connector assembly may include two or more interlock contacts (not shown) that are joined with an interlock circuit, such as a high voltage interlock (HVIL) circuit (not shown). The HVIL circuit remains open until the connector assembly 100 mates with the mating connector assembly and the electric shunt 226 engages the interlock contacts in the mating connector assembly and thereby closes the HVIL circuit. The closing of the HVIL circuit may indicate to a component that is joined with one or more of the connector assembly 100 and the mating connector assembly that the two assemblies 100, 102 are mated and that electric current may be conveyed between the assemblies 100, 102.

In the illustrated embodiment, the connector assembly 100 includes a seal element 228 disposed at or around the mating end 108 of the outer housing 106. The seal element 228 may be provided along the outer perimeter of the interior chamber 204 of the outer housing 106 at the mating end 108. The seal element 228 includes one or more elastomeric bodies that provide an environmental seal against the ingress of contaminants into the interior chamber 204 through the mating end 108. For example, the seal element 228 may be compressed between the mating connector assembly and the outer housing 106 to seal the interior chamber 204 from the ingress of moisture. A seal retainer body 230 may be secured to the mating end 108 of the outer housing 106. The seal retainer body 230 holds the seal element 228 at the mating end 108. The seal retainer body 230 may be a rigid body that at least partially compresses the seal element 228 between the seal retainer body 230 and the outer housing 106.

A cable seal 232 is disposed within the outer housing 106 in the illustrated embodiment. The cable seal 232 may be a planar elastomeric body. For example, the cable seal 232 may have a body that has outer dimensions in two perpendicular dimensions that are larger than the outer dimension of the body in a third perpendicular dimension. The cable seal 232 may include channels 234 that extend through the cable seal 232. In the illustrated embodiment, one of the channels 234 provides an opening in the cable seal 232 through which the cable 116 may extend. As described below, the cable seal 232 may be an elastomeric body that, when coupled with the cable 116 and the plug 104, provides an environmental seal at or near the back end 200 of the outer housing 106.

The retainer 112 is joined to the back end 200 of the outer housing 106. The retainer 112 may include, or be formed from, a dielectric material. For example, the retainer 112 may be molded from one or more polymers. Alternatively, the retainer 112 may include or be formed from a conductive material. The retainer 112 extends from a front end 246 to the back end 110. The retainer 112 includes opposite side surfaces 248, 250. Each of the side surfaces 248, 250 include an aperture 252 in the illustrated embodiment. The apertures 252 receive the protrusions 244 of the outer housing 106 to secure the retainer 112 to the outer housing 106. The retainer 112 is joined to the outer housing 106 to enclose the back of the connector assembly 100 and to hold the cable seal 232 within the connector assembly 100. The retainer 112 and outer housing 106 may be joined together such that the cable seal 232 is compressed between the retainer 112 and the back end 216 of the inner housing 214.

Figure 3:
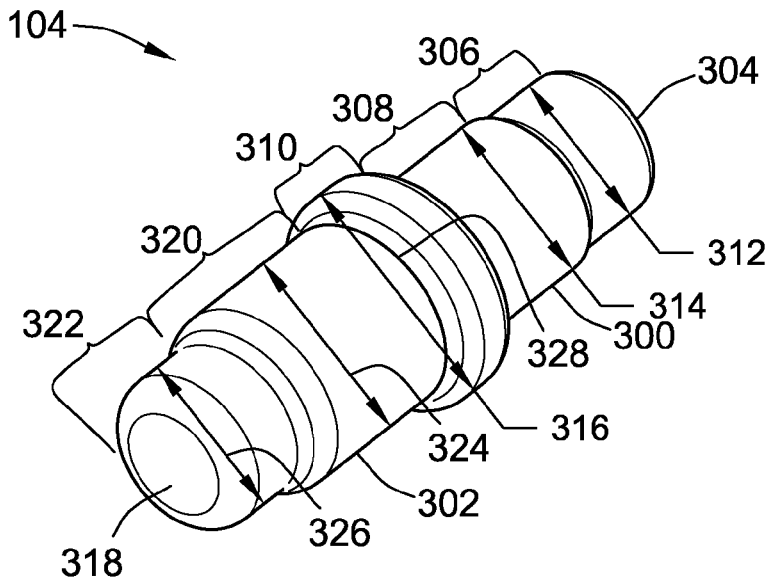
FIG. 3 is a perspective view of a plug shown in FIG. 1 in accordance with one embodiment of the present disclosure.
Figure 4:
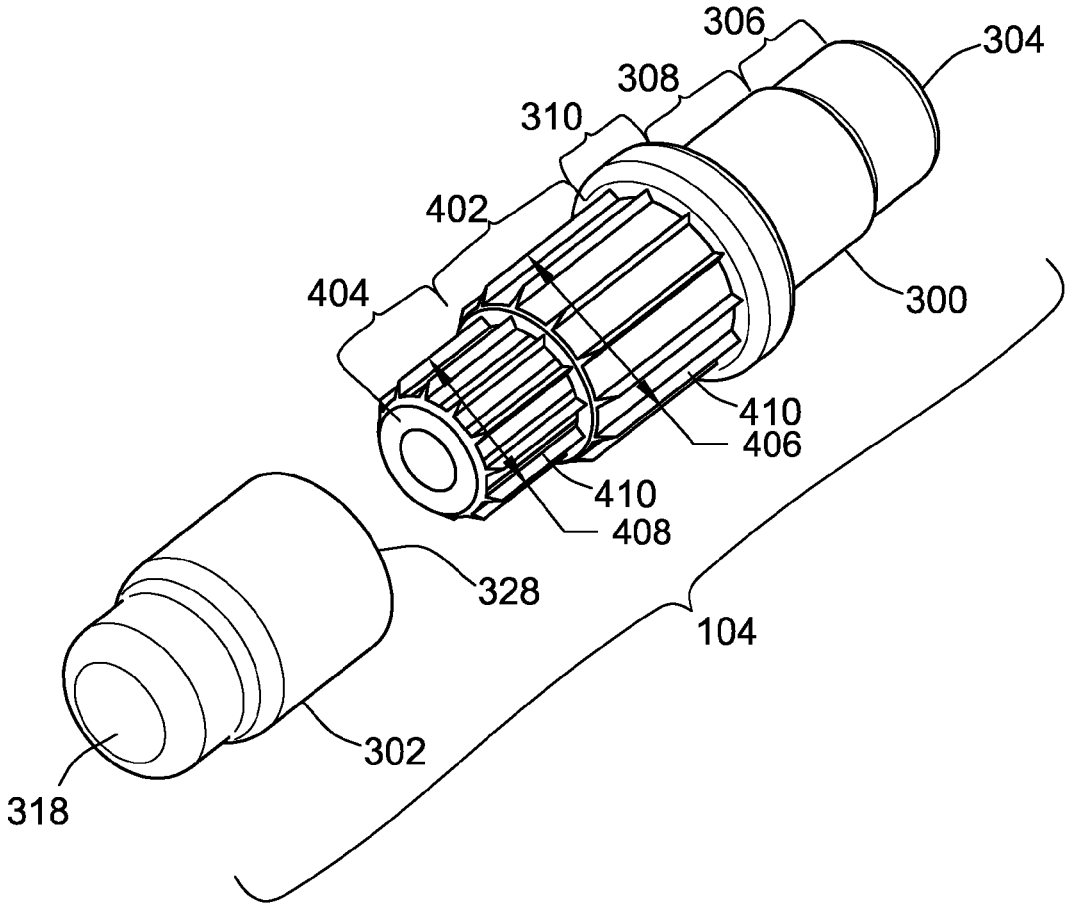
FIG. 4 is an exploded view of the plug shown in FIG. 1 in accordance with one embodiment of the present disclosure.

FIG. 3 is a perspective view of the plug 104 in accordance with one embodiment of the present disclosure. FIG. 4 is an exploded view of the plug 104 in accordance with one embodiment of the present disclosure. The plug 104 includes a body 300 and a conductive cap 302. The body 300 longitudinally extends from a front end 400 (shown in FIG. 4) to a rear end 304. The body 300 may be a rigid or semi-rigid body that includes, or is formed from, one or more dielectric materials. For example, the body 300 may be a single unitary body that may be partially compressed without plastic deformation. The body 300 may be molded from one or more polymers. Alternatively, the body 300 may include, or be formed from, one or more conductive materials. For example, the body 300 may be molded from a conductive polymer or a polymer that is embedded with conductive bodies.

The body 300 is an elongated generally cylindrical or tubular body that is staged in sections of varying diameters to form multiple sections 306, 308, 310, 402, 404 (both shown in FIG. 4). For example, each of the sections 306, 308, 310, 402, 404 may have an outside diameter dimension 312, 314, 316 (shown in FIG. 3), 406, 408 (both shown in FIG. 4) that is larger or smaller than one or both adjacent sections 306, 308, 310, 402, 404. In the illustrated embodiment, the end section 306 has the outside diameter dimension 312 that is smaller than the outside diameter dimension 314 of the adjacent middle section 308. The outside diameter dimension 314 of the middle section 308 is smaller than the outside diameter dimension 316 of the shoulder section 310. The outside diameter dimension 316 of the shoulder section 310 is larger than the outside diameter dimension 406 of the middle rib section 402. The outside diameter dimension 406 of the middle rib section 402 is larger than the outside diameter dimension 408 of the end rib section 404.

As shown in FIG. 4, the shoulder section 310 has the largest outside diameter dimension 316 of the sections 306, 308, 402, 404. The shoulder section 310 may be referred to as a shoulder of the body 300 as the shoulder section 310 radially projects from the body 300 farther than the other sections 306, 308, 402, 404. The end and middle rib sections 404, 402 include protrusions 410 that project from the body 300. The protrusions 410 are longitudinally elongated along a portion of the length of the body 300. For example, both the body 300 and the protrusions 410 are elongated in parallel directions. The protrusions 410 are crush ribs in the illustrated embodiment. Alternatively, the protrusions 410 may not be elongated and/or may not be crush ribs. For example, the protrusions 410 may be nubs or other projections extending from the body 300. The outside diameter dimensions 406, 408 of the end and middle rib sections 402, 404 do not include the protrusions 410. The protrusions 410 project from the body 300 in the sections 402, 404 to increase the size of the body 300 in the sections 402, 404. As described below, the cap 302 is placed over the sections 402, 404 of the body 300 and is secured to the body 300 by an interference fit between the cap 302 and the protrusions 410.

The cap 302 longitudinally extends from a front end 318 to an engagement end 328. The cap 302 includes, or is formed from, a conductive material such as a metal or metal alloy. For example, the cap 302 may be stamped and formed from a single sheet of metal or metal alloy. In the illustrated embodiment, the cap 302 is formed as a cup such that the cap 302 may be placed over the end and middle rib sections 404, 402 (shown in FIG. 4) of the body 300. In another embodiment, the plug 104 may not include the cap 302. For example, the plug 104 may be formed as a single body that includes or is formed from a conductive material, such as a metal or metal alloy.

The cap 302 is an elongated generally tubular body that is staged in sections of varying diameters to form front and rear sections 320, 322. For example, the sections 320, 322 may have different outside diameter dimensions 324, 326. As shown in FIG. 3, the outside diameter dimension 324 of the rear section 320 is larger than the outside diameter dimension 326 of the front section 322. The cap 302 is joined to the body 300 by placing the cap 302 over the middle and end rib sections 402, 404 (shown in FIG. 4) of the body 300. The inside dimensions of the cap 302 may be sufficiently small that the protrusions 410 are at least partially compressed between the cap 302 and the body 300 and the protrusions 410 secure the cap 302 to the body 300 by an interference fit. Alternatively, the cap 302 may be secured to the body 300 using an adhesive or other component to affix the cap 302 to the body 300. As shown in FIG. 3, the cap 302 covers and extends from the front end 400 of the body 300 to the shoulder section 310 of the body 300.

Figure 5:
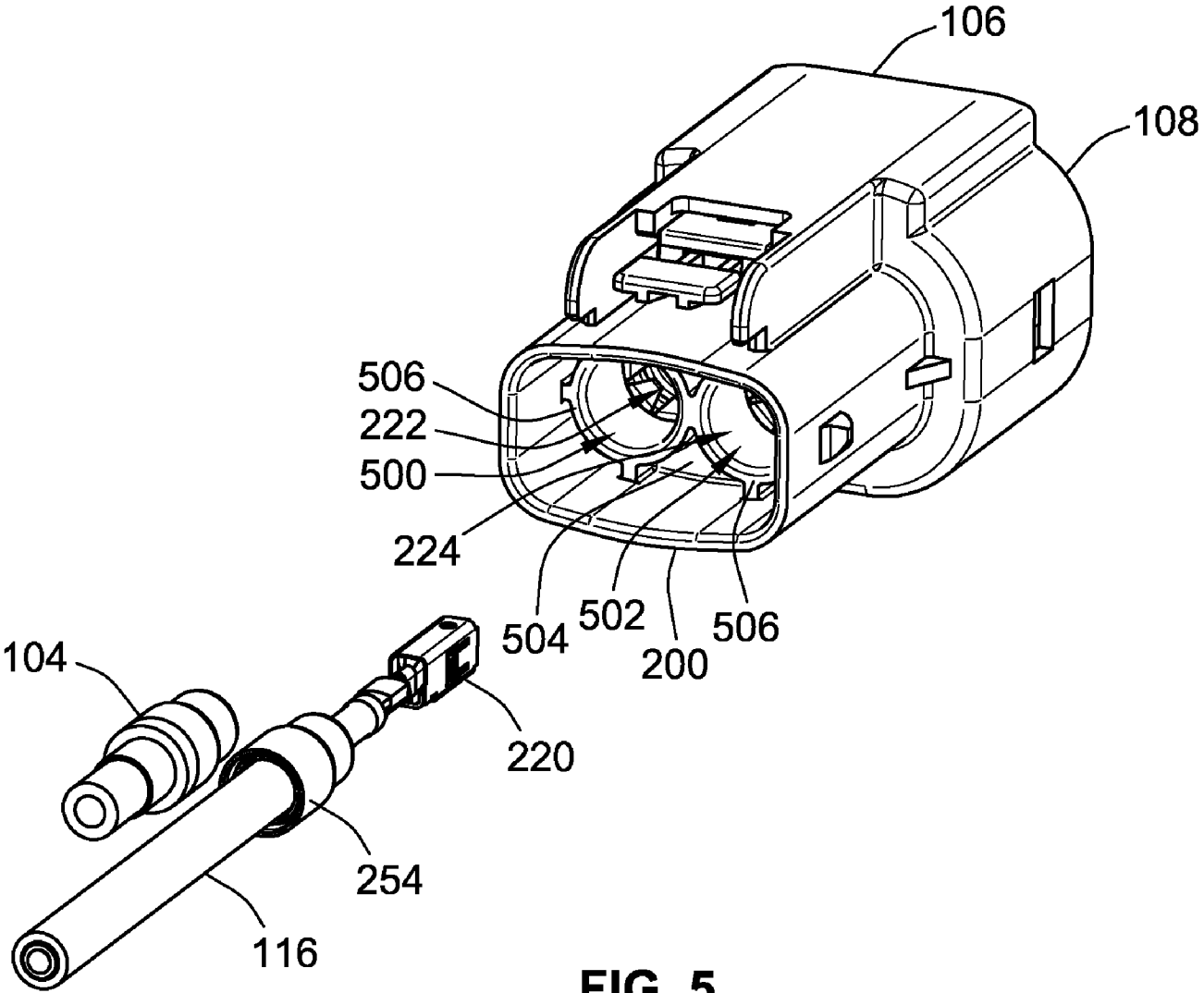
FIG. 5 is perspective view of an outer housing of the connector assembly shown in FIG. 1 in accordance with one embodiment of the present disclosure.

FIG. 5 is perspective view of the outer housing 106 of the connector assembly 100 prior to loading the plug 104, the contact 220, and the cable 116 into the outer housing 106 in accordance with one embodiment of the present disclosure. As shown in FIG. 5, the outer housing 106 includes openings 500, 502 that provide access to the cavities 222, 224 of the outer housing 106. For example, the openings 500, 502 extend through the interior wall 504 to the interior chamber 204. An elongated tubular collar 506 extends around each of the openings 500, 502 and projects from the interior wall 504 toward the back end 200. The openings 500, 502 are axially aligned with the cavities 222, 224. For example, the opening 500 may be aligned with the cavity 222 while the opening 502 is aligned with the cavity 224.

In the illustrated embodiment, the plug 104 is loaded into the opening 500 and into the cavity 222 and the contact 220 and at least a portion of the cable 116 is loaded into the opening 502 and at least partially into the cavity 224. Alternatively, the plug 104 may be loaded into the cavity 224 through the opening 502 and the contact 220 and cable 116 may be loaded into the cavity 222 through the opening 500.

Figure 6:
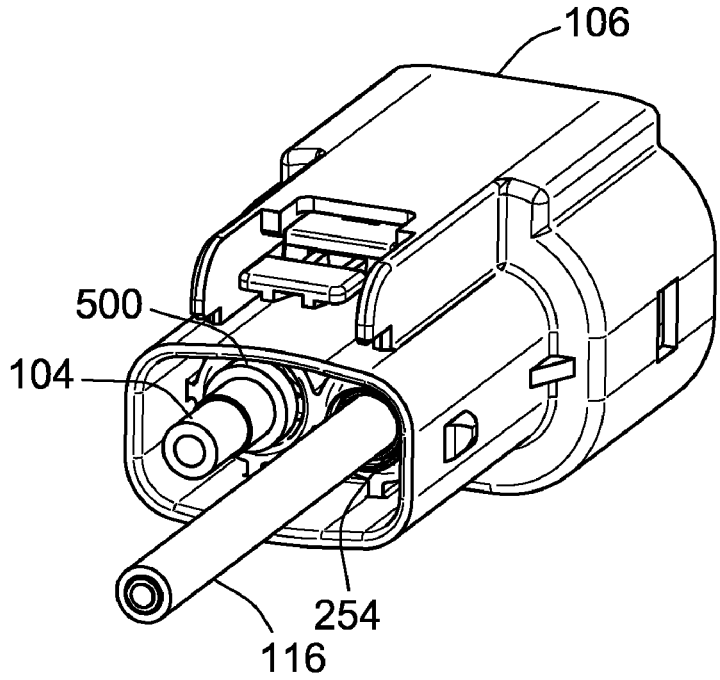
FIG. 6 is another perspective view of the outer housing of the connector assembly shown in FIG. 1 in accordance with one embodiment of the present disclosure.

FIG. 6 is perspective view of the outer housing 106 of the connector assembly 100 after loading the plug 104, the contact 220 (shown in FIG. 2), and the cable 116 into the outer housing 106 in accordance with one embodiment of the present disclosure. As described below, the plug 104 is loaded into the cavity 222 (shown in FIG. 2) through the opening 500 until the plug 104 engages both the shield 206 (shown in FIG. 2) and the inner housing 214 inside the outer housing 106. Also as described below, the contact 220 and the cable 116 are loaded into the cavity 224 (shown in FIG. 2) through the opening 502 until the collar 254 engages the shield 206.

Figure 7:
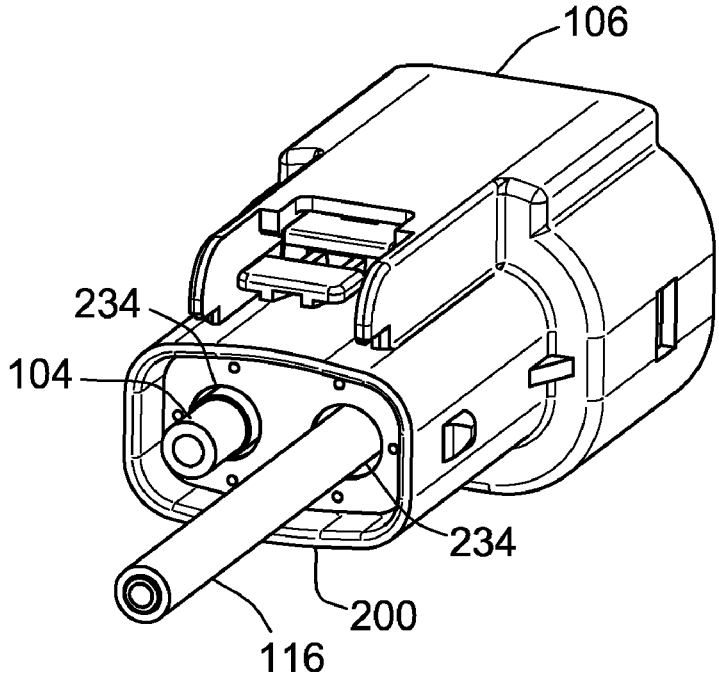
FIG. 7 is another perspective view of the outer housing of the connector assembly shown in FIG. 1 in accordance with one embodiment of the present disclosure.

FIG. 7 is a perspective view of the outer housing 106 of the connector assembly 100 after loading the plug 104, the contact 220 (shown in FIG. 2), the cable 116, and the cable seal 232 into the outer housing 106 in accordance with one embodiment of the present disclosure. As shown in FIGS. 6 and 7, once the plug 104, contact 220 and the cable 116 are loaded into the cavities 222, 224 (shown in FIG. 2) via the openings 500, 502 (shown in FIG. 5), the cable seal 232 is loaded into the outer housing 106 via the back end 200 of the outer housing 106. Alternatively, the cable 116 may be loaded through the cable seal 232 after the cable seal 232 is loaded into the outer housing 106. Each of the plug 104 and the cable 116 extends through a different channel 234 in the cable seal 232 and projects from the cable seal 232. Once the cable seal 232 is loaded into the outer housing 106 as shown in FIG. 7, the retainer 112 (shown in FIG. 1) is coupled to the outer housing 106 to secure the cable seal 232 in the outer housing 106.

The opening 120 (shown in FIG. 1) of the retainer 112 may be axially aligned with one of the channels 234 in the cable seal 232 and the opening 500 (shown in FIG. 5) of the outer housing 106 such that the plug 104 extends through each of the opening 500 in the outer housing 106, the channel 234, and the opening 120 in the retainer 112. The end section 306 (shown in FIG. 3) of the plug 104 may at least partially extend into the opening 120 in the retainer 112 to assist in locating or aligning the plug 104 in the outer housing 106. The plug 104 may partially extend into the opening 120 so that a user may be able to visually verify that the plug 104 is properly in place in the connector assembly 100.

Figure 8:
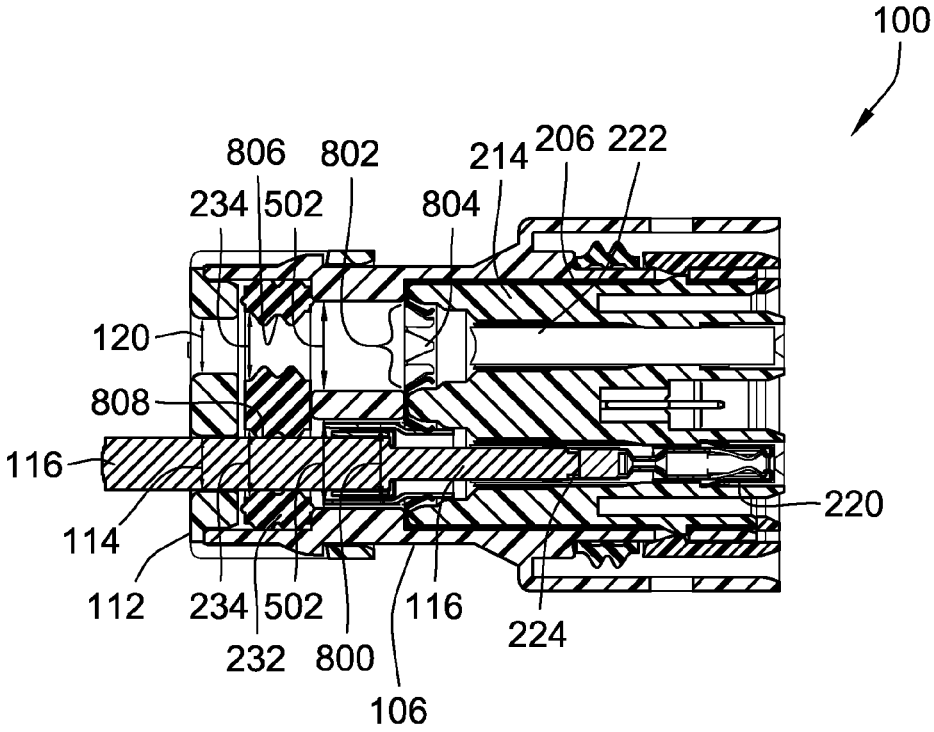
FIG. 8 is a cross-sectional view of the connector assembly shown in FIG. 1 taken along line A-A in FIG. 1 with the plug removed in accordance with one embodiment of the present disclosure.

FIG. 8 is a cross-sectional view of the connector assembly 100 taken along line A-A in FIG. 1 with the plug 104 (shown in FIG. 1) removed in accordance with one embodiment of the present disclosure. As shown in FIG. 8, the contact 220 and a portion of the cable 116 are disposed in the cavity 224 of the inner housing 214. The aperture 800 of the shield 206 is axially aligned with the cavity 224 of the inner housing 214, the opening 502 in the outer housing 106, one of the channels 234 of the cable seal 232, and the opening 114 in the retainer 112. The aperture 802 of the shield 206 is axially aligned with the cavity 222 of the inner housing 214, the opening 502 in the outer housing 106, a different channel 234 of the cable seal 232, and the opening 120 in the retainer 112.

The collar 254 of the cable 116 may engage the extensions 804 of the shield 206 to electrically couple the shield 206 with the collar 254. The collar 254 may engage the shield 206 to electrically couple the shield 206 with a conductor in the cable 116 that is joined with a ground reference and the collar 254. The collar 254 may engage the shield 206 around the aperture 800 to provide an EMI seal that prevents or restricts emission of EMI from the shield 206. For example, the collar 254 may outwardly bias the extensions 804 when the collar 254 is partially loaded into the aperture 800 in order to establish contact between the collar 254 and the shield 206. The contact between the collar 254 and the shield 206 restricts emission of electromagnetic interference out of the shield 206 through the aperture 800.

Also in the illustrated embodiment, inner surfaces 806 of the channels 234 in the cable seal 232 include protrusions 808 that project away from the surfaces 806. For example, the protrusions 808 may be ribs that project toward the axial center of the channels 234. The protrusions 808 may extend sufficiently far into the channels 234 that the protrusions 808 are compressed by the cable 116. The compression of the protrusions 808 may generate an interference fit between the cable seal 232 and the cable 116 around the corresponding channel 234 in order to provide an environmental seal. The engagement between the cable seal 232 and the cable 116 in the channel 234 through which the cable 116 extends prevents ingress of contaminants into the connector assembly 100 through the channel 234.

Figure 9:
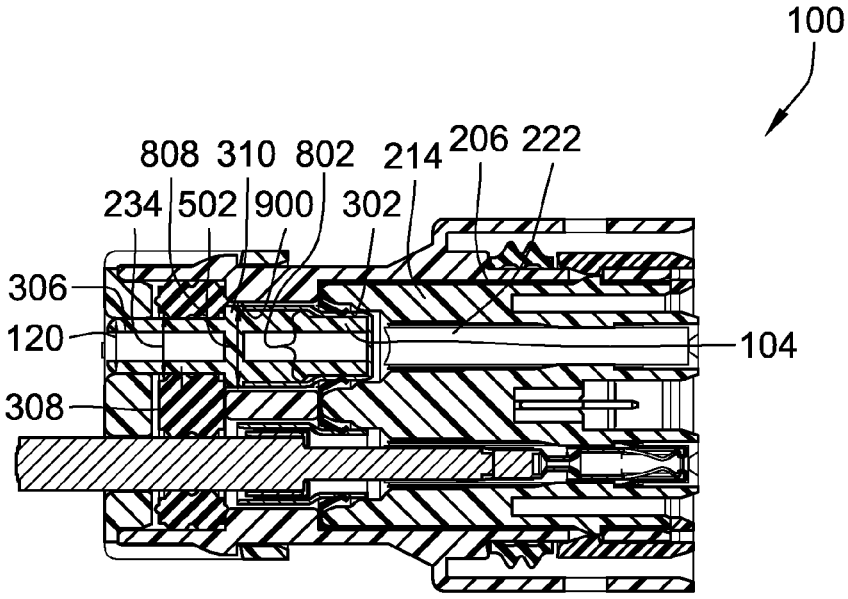
FIG. 9 is a cross-sectional view of the connector assembly shown in FIG. 1 taken along line A-A in FIG. 1 in accordance with one embodiment of the present disclosure.

FIG. 9 is a cross-sectional view of the connector assembly 100 taken along line A-A in FIG. 1 with the plug 104 inside the connector assembly 100 in accordance with one embodiment of the present disclosure. As shown in FIG. 9, the plug 104 is partially loaded into the cavity 222 of the inner housing 214 such that the plug 104 engages the shield 206, the outer housing 106, and the cable seal 232. The cap 302 of the plug 104 extends into the aperture 802 of the shield 206. The cap 302 engages the extensions 804 (shown in FIG. 8) of the shield 206 to provide an electric coupling between the cap 302 and the shield 206. The cap 302 adds to the shield 206 by electrically coupling with the shield 206 when the cap 302 engages the extensions 804. The engagement between the cap 302 and the shield 206 provides a seal around the aperture 802 that restricts or prevents emission of electromagnetic interference from the shield 206 through the aperture 802. For example, the cap 302 may add to the conductive body of the shield 206 and assist in sealing the aperture 802 to prevent or restrict leakage of EMI.

The plug 104 also engages the outer housing 106 at the same time that the plug 104 engages the shield 206. As shown in FIG. 9, the shoulder section 310 of the plug 104 engages an inside surface 900 of the opening 502 in the outer housing 106. The engagement between the shoulder section 310 and the opening 502 may locate the plug 104 within the outer housing 106. For example, the shoulder section 310 engages the opening 502 to position and align the plug 104 within the outer housing 106.

The plug 104 engages the cable seal 232 within the channel 234. In the illustrated embodiment, middle section 308 of the plug 104 engages the cable seal 232. The outside diameter dimension 314 of the middle section 308 may be sufficiently large that the middle section 308 compresses at least some of the protrusions 808 of the cable seal 232. Similar to as described above, the compression of the protrusions 808 may generate an interference fit between the cable seal 232 and the plug 104 in the channel 234. The interference fit provides an environmental seal that prevents ingress of contaminants into the connector assembly 100 through the channel 234 in which the plug 104 extends.

In the illustrated embodiment, the plug 104 also extends into the opening 120 in the retainer 112. As shown in FIG. 9, the end section 306 of the plug 104 at least partially extends into the opening 120 and engages the retainer 112 within the opening 120. The engagement between the end section 306 and the opening 120 may assist in aligning the plug 104 with respect to the retainer 112. For example, the plug 104 engages the retainer 112 to position and align the plug 104 with respect to the retainer 112. The location of the end section 306 within the opening 120 may also provide a user of the connector assembly 100 with the ability to visually verify that the plug 104 is located within the connector assembly 100.

The middle section 308 of the plug 104 may be sufficiently large to prevent removal or ejection of the plug 104 through the opening 102 in the retainer 112. For example, the outside diameter dimension 314 (shown in FIG. 3) of the middle section 308 may be larger than an inside diameter of the opening 102 such that the plug 104 cannot pass through the opening 102. The middle section 308 engages the retainer 112 inside the connector assembly 100 such that the plug 104 is secured between the retainer 112 and the shield 206 within the connector assembly 100.

Various embodiments of the present disclosure that are described herein set forth a plug that provides both an environmental seal and an electromagnetic interference seal to a connector assembly. The plug may be placed inside a connector assembly to simultaneously or concurrently prevent ingress of contaminants into the connector assembly and restrict emission of electromagnetic interference from the connector assembly.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

an outer housing including an interior chamber and an opening;

an electromagnetic shield disposed within the outer housing, the shield including a conductive body having an interior compartment and an aperture; and a plug disposed in the opening of the outer housing and engaged with the shield around the aperture of the shield such that the plug seals the opening in the outer housing and the aperture in the shield to prevent ingress of contaminants into the interior chamber of the outer housing and restrict emission of electromagnetic interference from the interior compartment of the shield, wherein the plug extends from a front end to an opposite rear end and the plug engages the shield without conveying electric current through the plug from the front end to the rear end.

2. The connector assembly of claim 1, wherein the plug includes an elongated body and a conductive cap joined to the body.

3. The connector assembly of claim 1, wherein the plug includes a body longitudinally extending from a front end to a rear end with a conductive cap at least partially extending over the front end and extending along a length of the body from the front end toward the rear end.

4. The connector assembly of claim 1, wherein the plug includes a body elongated between a front end and a rear end with a shoulder disposed therebetween and a conductive cap joined to the front end of the body and extending from the front end to the shoulder.

5. The connector assembly of claim 1, wherein the plug includes a body that extends from a front end to a rear end and a conductive cap, the front end of the body including crush ribs protruding from the body that secure the conductive cap to the body through an interference fit.

6. The connector assembly of claim 1, wherein the plug includes a cylindrical body having a shoulder radially projecting from the body, the shoulder engaging the outer housing.

7. The connector assembly of claim 1, wherein the shield includes extensions disposed around a periphery of the aperture in the shield, the plug electrically sealing the aperture by engaging the extensions.

8. The connector assembly of claim 1, further comprising a retainer joined to the outer housing and a cable seal disposed between the retainer and the outer housing, the cable seal including a channel through which the plug extends.

9. The connector assembly of claim 8, wherein the plug engages the cable seal to seal the interior chamber and prevent the ingress of the contaminants.

10. The connector assembly of claim 8, wherein the retainer includes an opening and the plug is received in the opening of the retainer.

11. The connector assembly of claim 1, further comprising a retainer joined to the outer housing, the retainer including an opening axially aligned with the aperture in the shield, wherein the plug includes a section that is sufficiently large to prevent removal of the plug through the opening.

12. A connector assembly comprising:

an outer housing including an interior chamber and an opening;

an electromagnetic shield disposed within the outer housing, the shield including a conductive body having an interior compartment and an aperture;

a retainer joined to the outer housing;

a cable seal disposed between the retainer and the outer housing, the cable seal including a channel extending therethrough; and a plug extending through the opening in the outer housing, the aperture in the shield, and the channel in the cable seal, wherein the plug prevents ingress of contaminants into the interior chamber of the outer housing by sealing the opening in the outer housing and restricts emission of electromagnetic interference by electrically sealing the aperture in the shield, wherein the plug extends from a front end to an opposite rear end and the plug engages the shield without conveying electric current through the plug from the front end to the rear end.

13. The connector assembly of claim 12, wherein the plug includes a body extending from a front end to a rear end with a conductive cap joined to and at least partially extending over the front end.

14. The connector assembly of claim 12, wherein the plug includes an elongated body and a conductive cap, the body extending from a front end to a rear end with a shoulder disposed therebetween, the conductive cap joined to the front end and extending from the front end to the shoulder.

15. The connector assembly of claim 12, wherein the plug includes a body and a conductive cap, the body extending from a front end to a rear end and including crush ribs protruding from the body, the crush ribs securing the conductive cap to the body through an interference fit.

16. The connector assembly of claim 12, wherein the plug includes a cylindrical body with a shoulder radially projecting from the body, the shoulder engaging the outer housing and aligning the plug in the outer housing.

17. The connector assembly of claim 12, wherein the shield includes extensions disposed around a periphery of the aperture in the shield, the plug engaging the extensions and electrically sealing the aperture.

18. The connector assembly of claim 12, wherein the plug compresses the cable seal within the channel of the cable seal.

19. The connector assembly of claim 12, wherein the retainer includes an opening and the plug extends through the channel of the cable seal and is received in the opening of the retainer.

20. The connector assembly of claim 12, wherein the plug includes a radially projecting shoulder that engages the outer housing inside the outer housing.

21. The connector assembly of claim 1, wherein the plug directly engages the shield around the aperture of the shield.

22. The connector assembly of claim 12, wherein the plug directly engages the shield around the aperture of the shield.

* * * * *